US005932968A

United States Patent [19]

Ghosh et al.

[11] Patent Number: 5,932,968

[45] Date of Patent: Aug. 3, 1999

[54] PLASMA DISPLAY CONFIGURATION

[75] Inventors: Asish Ghosh, Slingerlands; Alok Mani Srivastava, Schenectady, both of N.Y.

[73] Assignee: General Electric Company, Schenectady, N.Y.

[21] Appl. No.: 08/974,240

[22] Filed: Nov. 19, 1997

[51] Int. Cl.[6] ..... H01J 61/42

[52] U.S. Cl. ..... 313/582; 313/486; 313/485; 313/489; 313/112

[58] Field of Search ..... 313/582, 486, 313/485, 503, 489, 112

[56] References Cited

U.S. PATENT DOCUMENTS

| | | | |
|---|---|---|---|
| 3,893,445 | 7/1975 | Yasuda et al. | 313/485 |
| 4,429,303 | 1/1984 | Aboelfotoh | 313/485 X |
| 4,473,634 | 9/1984 | Dodds et al. | 430/272 |
| 4,853,254 | 8/1989 | Wolfe | 427/64 |
| 5,656,893 | 8/1997 | Shino et al. | 313/582 X |
| 5,793,158 | 8/1998 | Wedding, Sr. | 313/489 X |

OTHER PUBLICATIONS

A.E. Hardy, "Major Developments in Phosphors and Screen Application Techniques for Cathode Ray Tubes," RCA Engineer, pp. 12–18, Aug.–Sep. 1979.

*Primary Examiner*—Ashok Patel

*Attorney, Agent, or Firm*—Ernest G. Cusick; Noreen C. Johnson

[57] ABSTRACT

A plasma display comprises a face plate; at least one energy source; a first layer comprising pigmented phosphors; and a second layer comprising non-pigmented phosphors. The at least one energy source emits energy that is capable of exciting the non-pigmented phosphors of the second layer. Thus, the non-pigmented phosphors of the second layer emit energy comprising visible light. The first layer comprising the pigmented phosphors acts as a filter to filter the emissions from the non-pigmented phosphors of the first layer. Therefore, the plasma display has at least an increase in contrast of the energy emitted therefrom.

18 Claims, 2 Drawing Sheets

PLASMA DISPLAY CONFIGURATION

FIELD OF INVENTION

The invention is related to a use of pigmented phosphors for plasma displays. Further, the invention is related to pigmented phosphors for plasma displays that enhance contrast of the plasma displays.

BACKGROUND OF THE INVENTION

A display is the interface between an information using machine, for example, computer, measuring device, television or household appliance, and the user. Since the early 1950's plasma displays have been an important type of display. Starting with the Magnavox NIXIE numerical indicator tube, which was extensively used on instruments and controls of all sorts, plasma displays types and techniques have become very common. As it became possible to provide more and more information onto plasma panels, plamsa displays began to challenge cathode ray tubes, which at one time dominated the information display field.

A variety of plamsa displays have become known and are now being used. For example, plamsa displays have been proposed for use and used for in computers, laptop computers and high definition televisions. The acceptance of plasma displays emphasizes its high performance results, its clarity and definition of the display.

However, with the growing use of plasma displays the requirements and characteristics of plasma display configurations must be enhanced. The plasma displays should provide enhanced well-maintained color, brightness, superior lumen maintenance and display results.

It has been known to use filters in cathode ray displays in an attempt to enhance color, brightness, and display results. For example, it has been known to provide a filter in a cathode ray tube comprising a pigmented phosphor on an inner side of a cathode ray display face plate. The filter for use in cathode ray tubes provides acceptable results therein.

However, the use of the cathode ray display filter is unacceptable in a plasma display. This unacceptable nature is due, at least in part, to cost and spatial requirements for a filter for a plasma display, and differing operational and performance requirements of a plasma display. For example, filter, which would be acceptable in a cathode ray tube, would wash out over time in a plasma display. Therefore, a pigmented phosphor that is usable in a cathode ray tube is unacceptable in a plasma display.

SUMMARY OF THE INVENTION

Accordingly, it is desirable to provide a plasma display that overcomes the deficiencies of known plasma displays.

It is also desirable to provide a plasma display to enhance beneficial characteristics of the plasma display.

Further, it is desirable to provide a plasma display with pigmented phosphors filter, to enhance contrast in the plasma display.

Therefore, it is also desirable to provide a plasma display with enhanced contrast. The plasma display comprises a face plate; at least one energy source; a first layer comprising pigmented phosphors; and a second layer comprising non-pigmented phosphors. The at least one energy source emits energy that is capable of exciting the non-pigmented phosphors of the second layer. Thus, the non-pigmented phosphors of the second layer emit energy comprising visible light. The first layer comprising the pigmented phosphors acts as a filter to filter the emissions from the non-pigmented phosphors of the first layer. Therefore, the plasma display has at least an increase in contrast of the energy emitted therefrom.

These and other aspects, advantages and salient features of the invention will become apparent from the following detailed description, which, when taken in conjunction with the annexed drawings, disclose preferred embodiments of the invention.

BRIEF DESCRIPTION OF THE DRAWINGS

While the novel features of this invention are set forth in the following description, the invention will now be described from the following detailed description of the invention taken in conjunction with the drawings, in which.

DETAILED DESCRIPTION OF THE INVENTION

Figure 1:
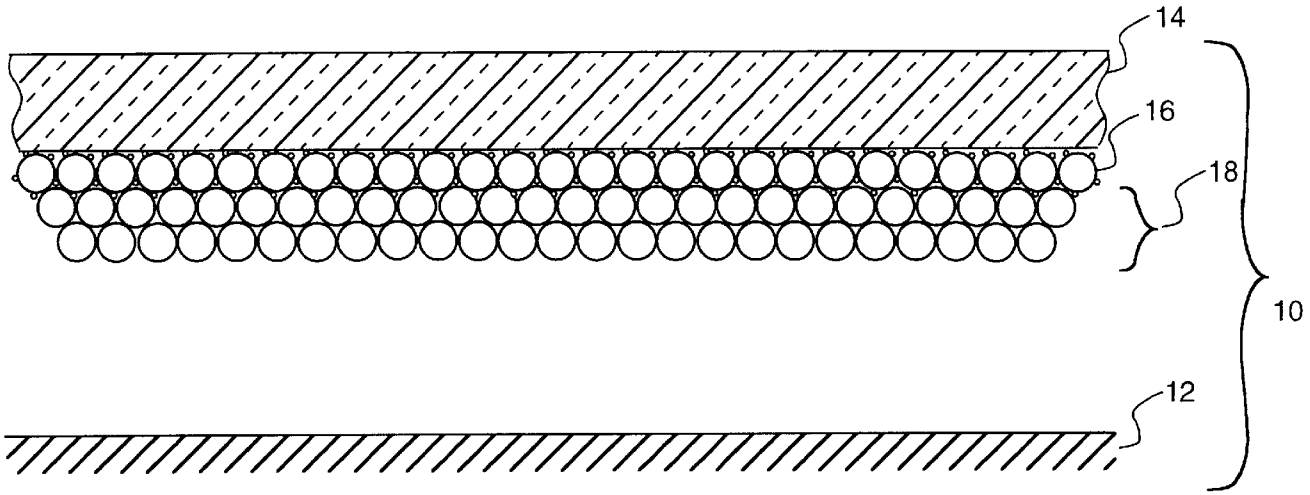
FIG. 1 is a side sectional schematic view of a plasma display, as embodied by the invention.

Cathode ray tubes and liquid crystal displays have previously relied on pigmented phosphors. For example, as discussed above, it has been known to use iron oxide as a red pigment for red-color phosphor, europium-doped yttrium oxide ($Y_2O_3$). When such a red-color phosphor, europium-doped yttrium oxide, is deposited on a face plate, such as a glass face plate, contrast of the display is enhanced for example about 10% to about 20%.

Cathode ray tubes presently employ pigmented phosphors. For example, for red color, the phosphor comprises a yttrium oxide $Y_2O_3$ that is europium ($Eu^{3+}$) activated with a $Fe_2O_3$ pigment. For a blue color, the phosphor comprises a zinc sulfide-silver activated and the pigment comprises cobalt aluminate. For green color, since the green emitted from a phosphor, such as zinc sulfide-copper activated, is readily visible to the eye, no pigment is needed for green light emitting phosphors.

In *Major Developments In Phosphors And Screen Application Techniques For Cathode Ray Tubes*, Hardy, RCA Engineer, (August–September 1979, pp. 12–18), Hardy notes that use of a Rauland blue pigmented phosphor significantly reduces tube face reflectivity (TFR) in a range between about 40% to about 30%. Further, Hardy notes that along with even with the reduction in TFR, the light output is reduced only about 5%, which is desirable.

While the effect observed by Hardy may be analogous to using a filter, it has a significantly high cost, both of materials, manufacture and upkeep in a plasma display system. The use of pigmented phosphors, as embodied by the invention, provides a filtering, but at lower costs, with enhanced contrast and integrity in a plamsa display.

Currently, plasma displays employ forms of phosphors, however they do not employ any pigmentation of the phosphors. The result is an inferior contrast, low color sharpness, reduced brightness and other poor display characteristics. Therefore, as embodied by the invention, a plasma display comprises phosphors with pigments, where the pigmented phosphors improve contrast, brightness, color sharpness and other characteristics of plasma displays.

Accordingly, in a plasma display as embodied by the invention, phosphors for blue and red colors are pigmented, while the green color phosphors are not pigmented, since the light is readily perceivable, as discussed above. Thus, as embodied by the invention, for red color, the pigmented phosphor comprises yttrium vanadate ($YVO_4$)-$Eu^{3+}$ activated, with a red pigment, for example, $Fe_2O_3$. The blue color in the plasma display, as embodied by the invention, comprises a phosphor, barium Magnesium Aluminate ($BaMg_2Al_{16}O_{27}$) that is europium activated, with a blue pigment, for example cobalt aluminate. For a green color, a phosphor such as a zinc silicate-manganese activated phosphor is used, and as discussed above, there is no need for a pigment on the green color phosphor.

Current commercial non-pigmented phosphors for use in displays normally have a particle size in a range between about 4 to about 7 microns in diameter. These commercially available phosphors are acceptable for use in a plasma display, however, as embodied by the invention, performance of plasma displays can be further enhanced. For example, a phosphor particle size that is desired in a plasma display may possess a diameter in a range between about 1 to about 3 microns, in order to minimize the size of the plasma display. Further, the smaller particle size of the phosphors provides enhanced contrast in a plasma display.

Figure 4:
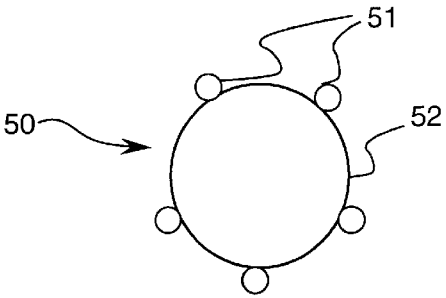
FIG. 4 is a schematic view of a pigmented phosphor, as embodied by the invention.
Figure 5:
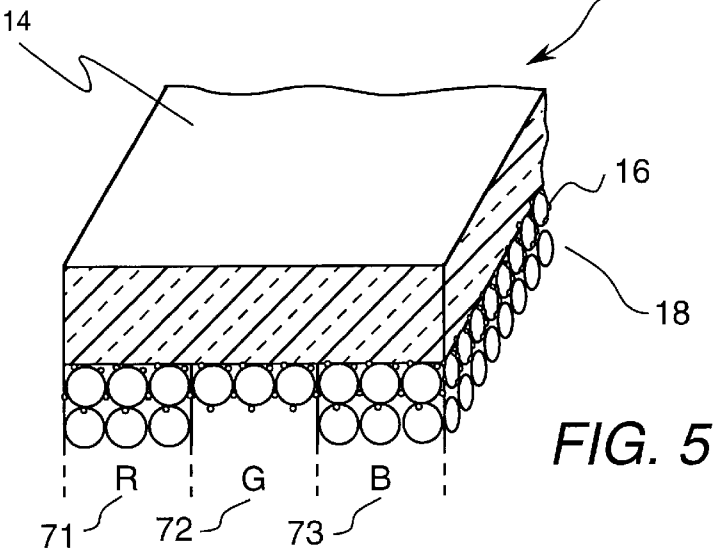
FIG. 5 is a schematic view of a face plate section in a plasma display with a pigmented phosphor, as embodied by the invention.
Figure 2:
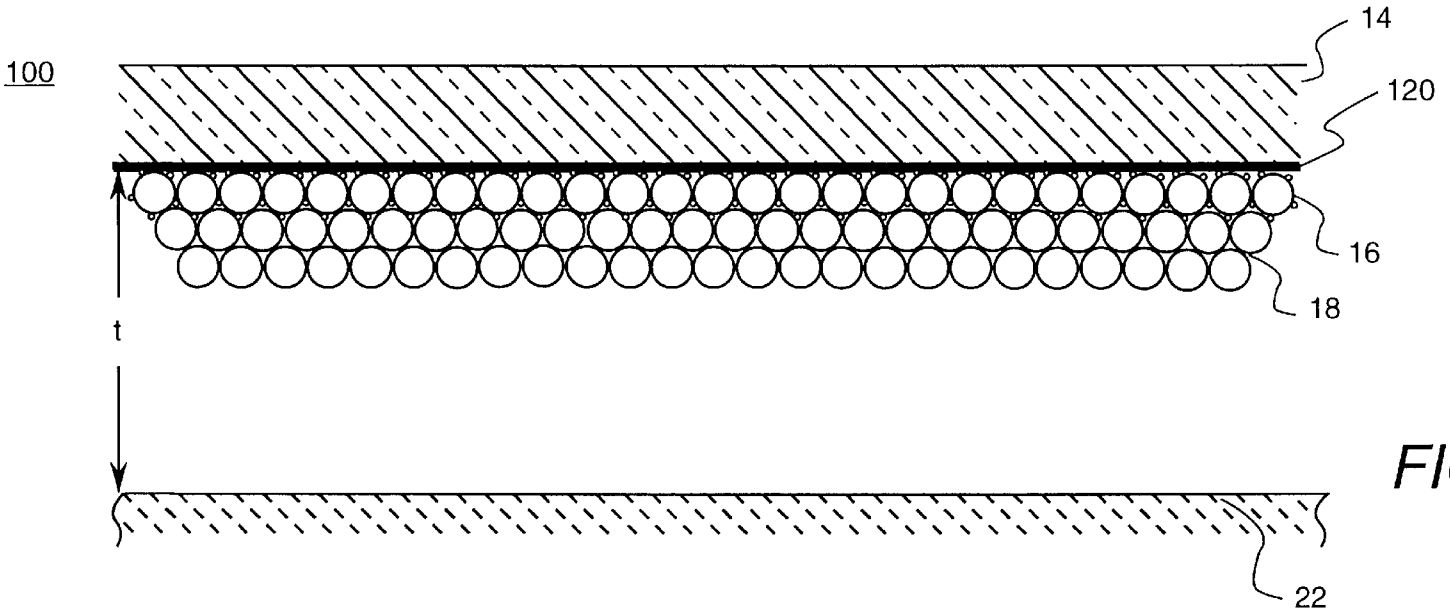
FIG. 2 is a side sectional schematic view of another plasma display, as embodied by the invention.
Figure 3:
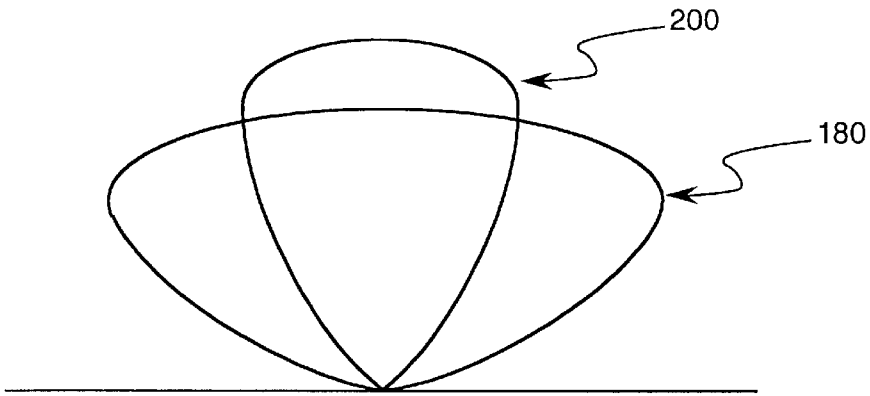
FIG. 3 is a graphical representation of luminance (units of ft-lamberts) for a conventional plasma display and a plasma display with a pigmented phosphor, as embodied by the invention.

A plasma display, as embodied by the invention, will now be described with respect to the figures. FIGS. 1 and 2 illustrate two embodiments of the plasma display, as embodied by the invention. FIG. 3 is a representation of luminance (in ft-lamberts) for a conventional plasma display and a plasma display as embodied by the invention. FIG. 4 is a perspective schematic representation of a pigmented phosphor, as embodied by the invention. FIG. 5 is a view of a portion of a plasma display, as embodied by the invention, illustrating individual color emitting areas of the plasma display.

In FIG. 1, a plasma display 10, as embodied by the invention, comprises at least one energy source 12. The energy source 12 is positioned behind the plasma display 10. The energy source 12 comprises any appropriate energy source, that excites phosphors. For example, for a color display the gas, such as a xenon mixture, when excited by an electron field emits an ultraviolet light. The ultraviolet light (UV light) excites different phosphors to emit visible light.

The plasma display 10 comprises an essentially transparent face plate 14. As is known in the art, the face plate 14 may comprise a single layer of essentially transparent material, such as but not limited to, glass and quartz. Alternatively, as is known in the art, the face plate 14 may comprise a plurality of essentially transparent layers, where the transparent layers are formed from appropriate materials. The exact composition and structure of the face plate 14 is not material to the invention, as long as the face plate 14 is essentially transparent so that light, generated as described by phosphors, can be transmitted through the face plate 14 of the plasma display 10.

A first layer 16 comprising pigmented phosphors is positioned behind the face plate 14. The first layer 16 comprising pigmented phosphors acts as a filter for the light generated by the plasma display 10, as described hereinafter. The first layer comprises at least one mono-layer of pigmented phosphors. The first layer 16 can comprise several mono-layers of pigmented phosphors. Preferably, the first layer 16 comprising pigmented phosphors comprises between about 1 to about 3 mono-layers of pigmented phosphors.

A second layer 18 comprises "regular" non-pigmented light emitting phosphors is positioned on the first layer 16 comprising pigmented phosphors. Thus, the first layer 16 is sandwiched by the face plate 14 and the second layer 18. The second layer 18 of non-pigmented phosphors comprises at least a plurality of mono-layer of non-pigmented phosphors. The second layer 18 of non-pigmented phosphors further preferably comprises between about 3 to about 5 mono-layers of non-pigmented phosphors.

The first layer 16 comprising pigmented phosphors acts to reduce the spread or focus the brightness emitted from the phosphors. Thus, the first layer 16 comprising pigmented phosphors forms a filter comprising of pigmented phosphors for the plasma display 10.

The second layer 18 of non-pigmented phosphors comprise "regular" light emitting phosphors, as is known in the art. These regular light emitting phosphors exhibit an emission when excited by a particular energy. The emission can be in the form of visible light, when the source of energy excites the light emitting phosphors in a certain manner. The behavior of light emitting phosphors is well established and understood in the art. Thus, a detailed explanation is omitted herein.

Accordingly, in the plasma display 10, as embodied by the invention, these regular non-pigmented light emitting phosphors in the second layer 18 emit a visible light when subjected to energy from the energy source 12. Normally, the visible light from the non-pigmented light emitting phosphors is emitted light in a full 360° degree spread or diffusion. This 360° spread is not beneficial in a plasma display, since the 360° spread or diffusion will cause a significant lack of contrast in the display. This is of course undesirable.

FIG. 3 illustrates lambertian distribution of light for plasma displays with a filter, as embodied by the invention and without the filter. A foot-lambert (ft-lambert) is unit of luminescence or surface brightness of a diffuse reflector emitting 1 lumen $cm^{-1}$ or $10^4/\pi$ cd $m^{-2}$. Further, the lambertian distribution is determined in conjunction with Lambert's Law, which states that illumination of a surface on which light falls normally from a point source is inversely proportional to the square of the distance from the source. These concepts are well known in the art.

In FIG. 3, the spread or focus from a plasma display 10 comprising only a layer of non-pigmented phosphors is represented by curve 180. As is illustrated that spread of light is wide, and thus a resulting contrast is low. The spread from a plasma display, comprising the layer 16 of pigmented phosphors, as embodied by the invention, is represented in FIG. 3 by curve 200.

Therefore, as embodied by the invention, the layer 16 of pigmented phosphors acts as a filter to focus the spread of emissions from the layer 18 of non-pigmented phosphors. The filtering by the layer 16 of pigmented phosphors sharpens the contrast in a plasma display 10, as embodied by the invention. In other words, the layer 16 of pigmented phosphors acts as a filter, and reduces a spread of the emissions, and sharpens the contrast, and therefore the display performance, of the plasma display 10.

Another plasma display 100, as embodied by the invention, is illustrated in FIG. 2. In FIG. 2, like reference characters are used to represent like elements. As illustrated, the source of energy 120, for example a UV energy source, is positioned proximate the face plate 14. As illustrated in FIG. 2, the source of energy 120 can be adjacent the face plate 14. Alternatively, the source of energy 120 can be positioned on and in contact with the face plate 14.

A first layer 16 comprises pigmented phosphors 16 and a second layer 18 comprises non-pigmented light emitting phosphors 18. These layers 16 and 18 are positioned proximate the energy source 120, either be positioned on and in contact with, or adjacent thereto.

A reflective surface element 22 is positioned a distance t away from the energy source 120 and plasma display 100. The reflective surface 22 is positioned to reflect energy, for example UV energy, from the energy source 120, back towards the face plate 14, the layers 16 and 18 of the plasma display 100.

The reflective surface 22 comprises any appropriate reflective material, that can adequately reflect energy without absorbing too much of the energy. These reflective materials include, but are not limited to metals, alloys, glasses, coated materials, ceramics and combinations of these materials. The material for the reflective surface 22 should reflect energy emitted from the energy source 120 back towards the first layer 16 comprising pigmented phosphors and the second layer 18 comprising non-pigmented light emitting phosphors. Thus, the reflected energy from the energy source 120 will generate emissions by the non-pigmented light emitting phosphors of the second layer 18. The generated emissions will then be filtered by the first layer comprising pigmented phosphors 16.

The plasma display, as embodied by the invention, improves contrast by coating an internal surface of the face plate 14 with at least one layer 16 of pigmented phosphors. The layer 16 further comprises at least two layers, and preferably about 3 layers of pigmented phosphors. The layer 18 of light emitting non-pigmented phosphors is placed on the layer.

The layer 18 comprising non-pigmented phosphors can be placed on the layer 16 of pigmented phosphors by an appropriate process. For example, but not limiting of the invention, the layer 18 can be placed by screening, including dusting and other known processes.

The non-pigmented phosphors of the layer 18 are generally formed of a phosphor composition normally used for the desired color. However, the pigmented phosphors of the layer 16 are heavily pigmented with small pigment particles. These pigment particles are inorganic color pigments, for example but not limited to iron oxide for red color phosphors and cobalt aluminate for blue color phosphors. Accordingly, the layer 16 of pigmented phosphors functions essentially as a filter, thereby increasing contrast in a plasma display and also provide enhanced well-maintained color, brightness, superior lumen maintenance and display results.

A pigmented phosphor 50 as in the first layer 16 of pigmented phosphors 16 is schematically represented in FIG. 4. The pigmented phosphor 50 comprises pigments 51 positioned on the surface of a phosphor 52. Methods for the manufacture of pigmented phosphors, as embodied by the invention, are known in the art, as described below. For example, U.S. Pat. No. 4,473,643 to Dodds et al. and U.S. Pat. No. 4,853,254 to Wolfe disclose processes for the manufacture of pigmented phosphors.

While the processes disclosed in these patents produce pigmented phosphors that are useful for the applications as discussed therein, the pigmented phosphors described therein are not sufficient for use in plasma displays. The process of Dodds and Wolfe are employed in the invention to produce the pigmented phosphors, as embodied by the invention. The actual phosphors described therein are not within the scope of the invention. These pigmented phosphors are not acceptable for plasma displays, at least, because they do not exhibit adequate adhesion to the components of the display. Further, the pigmented phosphors are not acceptable for plasma displays as they do not become excited by the UV light source that is used in plamsa displays.

Accordingly, it has been discovered that a particular pigmented phosphor composition is needed to overcome the problems associated with known pigmented phosphors with respect to a plasma display. Further, as embodied by the invention, the pigmented phosphors are applied to the plamsa display face plate so the pigmented phosphors remain intact on the surface of the layer of non-pigmented phosphors, and provide an acceptable contrast in the plasma display.

Pigmented phosphors, as embodied by the invention, comprise a composition to provide acceptable adhesion onto components of a plasma display. Further, the pigmented phosphors also provide a desired and acceptable contrast from the plasma display. Furthermore, the pigmented phosphors in the plasma display as embodied by the invention also provide an enhanced contrast in the display itself.

The pigmented phosphors, as embodied by the invention, are formed by a process selected from either a latex based operation or a sodium silicate based operation. These processes will now be discussed. The processes may be used to produce any one of the pigmented phosphors, which are within the scope of the invention. While either process is within the scope of the invention, the sodium silicate based operation is beneficial with inorganic pigments, as discussed herein.

The latex based operation comprises combining the pigments, as discussed above, with latex and phosphors. The combination of these constituents places the pigments on the phosphor. The phosphors with pigments are then ball milled to achieve the pigmented phosphors, as embodied by the invention. This latex based operation for the preparation of pigmented phosphors in a CRT has been described and is known in the art, for example described by Wolfe in U.S. Pat. No. 4,853,254.

The sodium silicate based process comprises combining the pigments with silicates and phosphors. This combining step is then followed by ball-milling, to provide the pigmented phosphors, as embodied by the invention. This sodium silicate based operation for the preparation of pigmented phosphors in a CRT has been described and is known in the art, for example described by Dodds in U.S. Pat. No. 4,473,634.

The pigmented phosphors, as embodied by the invention, for a plasma display, comprise pigments and phosphors. The pigments are provided in an amount in the pigmented phosphors in a range between about 1% to about 10% by weight. Further, pigments are provided in an amount in the pigmented phosphors in a range between about 1% to about 5% by weight. The amount by weight of the pigments will be optimized to achieve the greatest possible brightness, however in no event will the amount, by weight, of pigments be greater than about 10%.

The size of the pigmented phosphors 50 as embodied by the invention is such that the layers 16 and 18 will adhere to the face plate 14 of the plasma display 10, and provide the necessary contrast. Accordingly, the phosphor 52 has a size generally about 5 microns in diameter, while the pigments generally have a size about less than a micron in diameter. Thus, the pigmented phosphors 50 will adhere to the face plate 14 of the plasma display 10, and provide the necessary contrast.

FIG. 5 illustrates is a schematic view of a face plate 10 section in a plasma display 10 with pigmented phosphors, as embodied by the invention. in FIG. 5, each section of the display includes individual blue, green and red light emitting sections. In other words, the plasma display is divided into pixel like elements for each color. The red light emitting section 71 and the blue light emitting section 73 include the layers 16 and 18, as discussed above. The green light emitting section 72 comprised the layer 18 only since the green light is sufficiently visible without a filter layer of pigmented phosphors.

While the embodiments described herein are preferred, it will be appreciated from the specification that various combinations of elements, variations or improvements therein may be made by those skilled in the art are within the scope of the invention.

What we claim:

1. A plasma display comprising:

a face plate;

at least one energy source;

a first layer comprising pigmented phosphors; and a second layer comprising non-pigmented phosphors;

wherein the at least one energy source emits energy that is capable of exciting the non-pigmented phosphors of the second layer so the non-pigmented phosphors of the second layer emit energy comprising visible light, the first layer comprising the pigmented phosphors acts as a filter to filter the emissions from the non-pigmented phosphors of the first layer, thereby at least increasing contrast of the energy emitted from the plasma display.

2. A display according to claim 1, the first layer comprising pigmented phosphors comprising a pigmented phosphor comprising $(YVO_4)$-$Eu^{3+}$ activated, further comprising a $Fe_2O_3$ red pigment.

3. A display according to claim 1, the first layer comprising pigmented phosphors comprising a pigmented barium magnesium aluminate $(BaMg_2Al_{16}O_{27})$ that is europium activated, further comprising a cobalt aluminate blue pigment.

4. A display according to claim 1, the plasma display further comprising a zinc silicate-manganese activated phosphor.

5. A display according to claim 4, wherein the zinc silicate-manganese activated phosphor emits green visible light, the green visible light comprising sufficient contrast so as to possess sufficient contrast as if filtering by the first layer occurred.

6. A display according to claim 1, the first layer comprising pigmented phosphors comprising a pigmented phosphor comprising $(YVO_4)$-$Eu^{3+}$ activated, further comprising a $Fe_2O_3$ red pigment and pigmented phosphors comprising a pigmented barium magnesium aluminate $(BaMg_2Al_{16}O_{27})$ that is europium activated, further comprising a cobalt aluminate blue pigment, the plasma display further comprising a zinc silicate-manganese activated phosphor.

7. A display according to claim 1, wherein the face plate is essentially transparent and the layer of non-pigmented phosphors emits visible light that is transmitted through the face plate.

8. A display according to claim 1, the face plate comprises at least one of glass and quartz.

9. A display according to claim 1, the at least one energy source comprises at least one ultraviolet energy source.

10. A display according to claim 9, the at least one ultraviolet energy source comprises a xenon gas mixture activated by an electric field.

11. A display according to claim 1, the pigmented phosphors of the first layer are formed by a process selected from the group consisting of a latex based process and a sodium silicate based process.

12. A display according to claim 1, the pigmented phosphors of the first layer comprise a phosphor having a size of about 5 microns in diameter and at least one pigment having a size of about less than one micron in diameter.

13. A display according to claim 1, the first layer of pigmented phosphors comprises at least one mono-layer of pigmented phosphors.

14. A display according to claim 1, the first layer of pigmented phosphors comprises pigmented phosphor mono-layers in a range between about 1 pigmented phosphor mono-layer to about 3 pigmented phosphor mono-layers.

15. A display according to claim 1, the second layer of non-pigmented phosphors comprises at least one mono-layer of non-pigmented phosphors.

16. A display according to claim 1, the second layer of non-pigmented phosphors comprises non-pigmented phosphor mono-layers in a range between about 3 non-pigmented phosphor mono-layer to about 5 non-pigmented phosphor mono-layers.

17. A display according to claim 1, wherein the at least one energy source is positioned proximate and spaced from the face plate, the first layer of pigmented phosphors being positioned on the face plate and the second layer of non-pigmented phosphors being positioned on the first layer of pigmented phosphors, so energy from the at least one energy source is transmitted from the at least one energy source to the second layer of non-pigmented where the non-pigmented phosphors are excited and emissions pass through and are filtered by the first layer of pigmented phosphors, and then pass through the face plate.

18. A display according to claim 1, further comprising at least one reflective surface, the at least one reflective surface positioned proximate and spaced from the face plate, wherein the at least one energy source is positioned adjacent to the face plate, the first layer of pigmented phosphors being positioned on the at least one energy source and the second layer of non-pigmented phosphors being positioned on the first layer of pigmented phosphors, so that energy from the at least one energy source is transmitted from the at least one energy source through the first layer of pigmented phosphors, through the second layer of non-pigmented phosphors, reflects off the at least one reflective surface and then through the second layer of non-pigmented phosphors, where the non-pigmented phosphors are excited and emissions pass through and are filtered by the first layer of pigmented phosphors, and then pass through the face plate.

* * * * *